US005458520A

United States Patent [19]

DeMercurio et al.

[11] Patent Number: 5,458,520

[45] Date of Patent: Oct. 17, 1995

[54] METHOD FOR PRODUCING PLANAR FIELD EMISSION STRUCTURE

[75] Inventors: Thomas A. DeMercurio, Beacon; Kwong H. Wong; Roy Yu, both of Wappinger Falls, all of N.Y.

[73] Assignee: International Business Machines Corporation, Armonk, N.Y.

[21] Appl. No.: 354,578

[22] Filed: Dec. 13, 1994

[51] Int. Cl.[6] ..... H01J 9/02; H01J 1/30

[52] U.S. Cl. ..... 445/24; 445/50

[58] Field of Search ..... 445/24, 50, 51

[56] References Cited

U.S. PATENT DOCUMENTS 5,378,182 1/1995 Liu ..... 445/24

FOREIGN PATENT DOCUMENTS 4-242039 8/1992 Japan ..... 445/51

5-205615 8/1993 Japan ..... 445/51

*Primary Examiner*—Mark Rosenbaum

*Assistant Examiner*—Jeffrey T. Knapp

*Attorney, Agent, or Firm*—Perman & Green

[57] ABSTRACT

A method is available for producing planar field emission elements such as used in camcorder view finder screens, instrument display panels, computer monitors, television displays and similar systems. Prior known methods are simplified to avoid the need for precision milling while controlling precise via hole diameters and producing wider via passage to eliminate shorting. The method involves the use of electroplating steps to reduce etched via hole diameters, using different metals to permit selective separation.

18 Claims, 1 Drawing Sheet

METHOD FOR PRODUCING PLANAR FIELD EMISSION STRUCTURE

BACKGROUND OF THE INVENTION

This invention relates to a method for producing a planar type electron radiating field emission structure used for a flat panel display and, more particularly, to a flat type electron radiating device for radiating electrons from a plurality of pointed end cathodes.

Investigations are presently being conducted into planar type image display devices as image display replacements for the currently employed CRT for television receivers. Such planar type image display devices are exemplified by liquid crystal displays, electroluminescence devices and plasma display panels. A field emission type image display device is also attracting attention in respect of display luminosity on the viewing screen surface.

In a field emission type image display device a number of conically-shaped cathodes, such as of molybdenum, with a diameter of not more than 1.0 μm, formed on a substrate by a semiconductor producing process, are used as radiation sources, and a plate-shaped gate electrode, provided with holes in register with the cathodes, is formed at the distal ends of the cathodes. The gate electrode is spaced apart from the distal ends of the cathodes and a high electrical voltage is applied across the gate electrode and the cathodes to produce field emission and extract an electron beam from the cathodes. This electron beam is irradiated on light emitting particles (phosphors) arranged on the back side of an anode to display a desired picture such as on a camcorder viewfinder screen, instrument display panels, computer monitors and television displays.

A wide variety of processes have been proposed and/or are used to produce electron-radiating devices or field emission structures and reference is made to U.S. Pat. Nos. 243,252; 5,278,472; 5,219,310; 5,188,977 and 5,007,873 for their disclosures of such processes.

The known processes involve one or more steps requiring expensive tooling, such as dry etching and evaporation, gate patterning with photo tools having extreme accuracy, use of a glancing angle evaporator to avoid shorting of cone vias, and other related steps which increase processing time and expense and require extreme precision.

For example, the patterning of the gate metal in certain prior known processes requires the use of a photo tool with greater than 1 μm resolution because the final width or diameter of the gate is controlled solely by the photo tool. This also necessitates the use of a relatively thick gate electrode layer, and the use of rotational glancing angle evaporation of the underlying insulating layer to form cathode vias which are wider than the gate opening, in order to avoid shorting of the cathodes.

Therefore the present process for producing planar field emission structures evolved from the need to overcome the aforementioned disadvantages and to provide a new process which is simplified, rapid, flexible, inexpensive and commercially practical for the production of planar field emission structures or devices.

SUMMARY OF THE INVENTION

The novel process of the present invention represents an improvement over prior known processes in that it enables the use of a thinner metal anode base layer, enables the use of less expensive, less precise photo tools for the etching of anode base layer features or openings which are much wider than required by prior known processes, enables the width of each anode opening to be reduced precisely to desired size preparatory to the cathode deposition step, and enables the use of a conventional reactive ion etch step to produce cathode vias having a width equal to the width of each anode base layer opening, without the need for a glancing angle evaporator.

The present method involves the following general steps:

(a) depositing at least one metal cathode line upon an electrically insulative substrate such as of glass or ceramic;

(b) applying a resistive layer, such as one having a resistivity of approximately 10 E5 to 10 E6 ohm-cm, over the metal cathode line to a desired thickness, such as between about 1 and 2 microns, preferably about 1.5 microns;

(c) depositing an etchable layer of polymer having a desired thickness, such as approximately 3–6 microns, over the resistive layer, forming a separation layer;

(d) depositing a thin layer of metal, such as of nickel, having a thickness such as of between about 0.2 and 1 micron, preferably approximately 0.5 micron, over the polymer layer, forming an anode base layer;

(e) forming relatively wide via holes in the anode base layer at selected locations, the via holes preferably having a diameter of 2 or more microns;

(f) electroplating a metal anode top layer over the anode base layer, forming a composite metal anode, the metal electroplating extending over the sidewalls of the base layer into the via holes so as to reduce the diameter of the via holes, the thickness of the metal electroplating depending upon the final desired diameter for the anode via holes, and generally being between about 0.2 and 1 micron, preferably about 0.5 micron;

(g) electroplating a second metal, dissimilar to the metal used in the first electroplating step, over the composite metal anode, forming a lift-off layer, the lift-off layer extending over the first electroplating metal and over the sidewalls of the anode via holes to temporarily reduce further the diameter of the via holes, the lift off layer having a thickness similar to that of the anode top plate;

(h) extending the anode via holes through the separation layer down to the resistive layer by reactive ion etching to form via passages, the sidewalls of each via passage having a diameter approximately the same size as the via holes in the anode base layer, before the first and second electroplating steps;

(i) evaporating a cathode metal dissimilar to the metal used in the second electroplating step, such as molybdenum, over the lift-off layer such that metal is deposited through each via hole onto the resistive layer without touching the separation layer wall of each via passage, the deposit resulting in metal accumulation over the resistive layer and metal cathode line to form sharply tipped conical cathodes, the tips of which extend into each via hole;

(j) selectively removing the lift-off layer, such as by deplating or by exposing it to a solvent or etchant for the metal in the lift-off layer which is a non-solvent for the metal used in any other step; and (k) removing the evaporation layer resulting in an exposed completed anode.

The formed anode can be patterned into a plurality of anode lines, in conventional manner, to provide a field emitter for a field emission display assembly such as for camcorder viewfinder screens, instrument display panels, computer monitors, television displays and similar systems.

Referring to the aforementioned steps, the novel polymer deposition step (c) provides a relatively thin, etchable separation layer between the resistive layer of step (b) and the anode underlayer of step (d); the subsequent reduction in the diameter of the via holes in plating steps (f) and (g) avoids the need for precision via machining in step (e); the application of a second metal plate lift-off layer in step (g), between the first metal plate anode overlayer of step (f) and the evaporation deposit layer of step (i) permits the selective removal of the lift-off layer and of the evaporation deposit layer supported thereby, to produce the complete anode.

Reference is made to the accompanying drawings in which.

DETAILED DESCRIPTION

Figure 1:
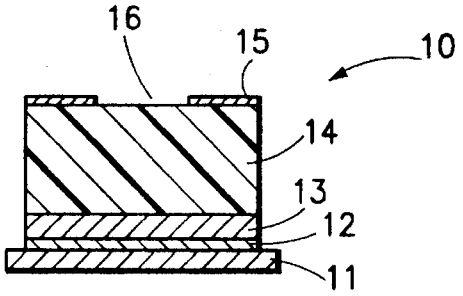
FIG. 1 is a diagrammatic cross-section, to an enlarged scale, of a substrate having a via-containing anode electrode base layer, produced as an intermediate product according to several steps of the present process.

Referring to FIG. 1 of the drawing, the intermediate element 10 thereof comprises an insulative substrate 11, such as glass having deposited thereon a thin x-line patterned cathode layer 12 of a metal such as molybdenum, over which is deposited a resistive layer 13 such as a sputtered layer of amorphous silicon preferably having a thickness of about 1.5 microns. Next an etchable separation layer 14 is applied over the resistive layer, and a thin anode base layer 15, such as a 0.5 micron thickness layer of a metal such as nickel, is applied over the separation layer 14. The final step in the preparation of the intermediate element 10 of FIG. 1 is the formation of the initial anode via holes 16, which step can be accomplished by simple resist and etching means since the holes 16 can have relatively large diameters of 2 or more microns. The etched diameter is not a final diameter since the widths of the initial via holes are reduced to desired exact final dimensions in subsequent metal plating steps. The etching can be done by conventional wet or dry methods, but wet etching is preferred.

Wet etching of the initial via holes 16 represents a substantial improvement over prior known processes in which the anode via holes are initially formed to their exact final dimensions of about 1.5 microns, which requires the use of expensive ion beam milling tooling and precision patterning. Moreover the present anode base layer 15 is applied as a thin, easily etched layer which is subsequently plated to increase its thickness and strength while reducing the width of the anode via holes, as illustrated by FIG. 2.

Figure 2:
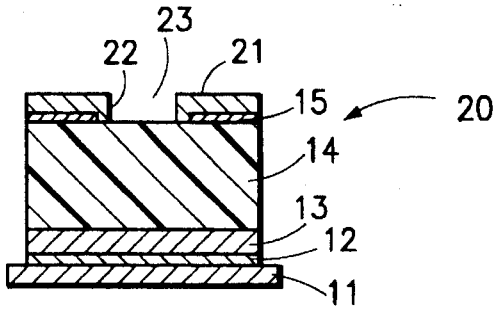
FIG. 2 is an illustration, similar to that of FIG. 1, showing the product after application of a first electroplating layer as an anode-reinforcing metal top layer which narrows the diameter of the anode vias.

FIG. 2 illustrates an intermediate element 20 comprising the element 10 of FIG. 1 after the step of plating the base anode layer 15 with a top anode plate layer 21 of a metal which may be the same as the metal of the base anode layer 15, e.g., a 0.5 micron thickness layer of nickel, which produces a composite metal anode electrode layer of increased thickness, i.e., 1 micron. More importantly, the thickness of the top anode plate layer 21 can be controlled with high precision since it is applied by conventional electroplating means. Therefore, the thickness of the plate portion 22, deposited over the via edges of the base layer 15, can be precisely controlled to regulate the width of the composite anode via holes 23. Moreover, the plated areas 21 and 22 are of uniform thickness and smoothness and correct the rough via shape which might be formed during the non-uniform wet sub-etch formation of the initial via holes 16.

It should be pointed out that the composite anode layer, comprising base layer 15 and top layer 21, can be removed and re-deposited if necessary for any reason, such as to change the desired diameter of the via 23. Since layers 15 and 21 may consist of the same metal, such as nickel, they can be etched away or otherwise removed by any suitable means, and the base layer 15 can be redeposited over the separation layer 14 and new via holes, larger or smaller in diameter than the original via holes 16 can be formed. Thereafter the anode top layer 21 is deposited to form the final anode via holes which may be larger or smaller than the original via holes 23. Such reworking of the composite anode layer can be accomplished at any time up until the removal of the polymeric separation layer.

Figure 3:
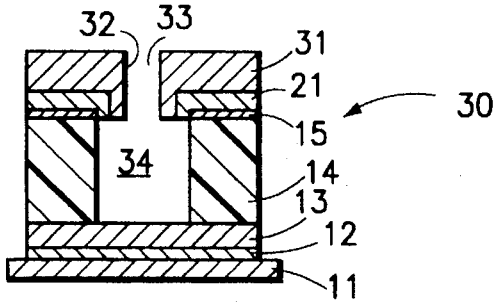
FIG. 3 is an illustration similar to that of FIG. 2, showing the product after application of a second electroplating layer of a different metal to form a lift-off layer which further narrows the diameter of the anode vias, and after etch-removal of the separation layer to form a widened via passage beneath the anode layer down to the resistive layer over the cathode layer.

FIG. 3 illustrates an intermediate element 30 comprising the element 20 of FIG. 2 after the application of a liftoff layer 31, in a second electroplating step, followed by an etching step to form wide via passages 34 through the separation layer 14 down to the surface of the resistive layer 13.

The lift-off plate layer 31 comprises an electroplate of metal different from those of the composite metal anode layer 15/21, e.g., copper, since the lift-off layer 31 must be selectively removable from the top anode plate layer 21 in a later step in the process. The lift-off plate layer 31, such as a 0.5 micron thick copper layer, preferably has a uniformity and smoothness similar to that of the anode nickel plate layer 21, and extends over the via edges as plate portion 32 to further reduce the diameter of the via holes 33, down to the surface of the separation layer, shown by means of broken lines in FIG. 3. The electroplating of the layer 31 enables the width of the via holes 33 to be controlled with great precision.

The electroplating of the layer 31 also avoids the prior art requirement for depositing the metal lift-off layer by expensive glancing angle evaporation means and enables the use of a thinner separation layer to reduce the time required to form the via passages 34 therethrough and to deposit the cathode cones therewithin.

The separation layer 14 of the present planar field emission element preferably is a solvent-applied, reactive ion-etchable synthetic polymer layer, such as of a polyimide polymer, having a thickness between about 3 and 6 microns, depending upon the thicknesses of the electroplate layers 21 and 31 which control the final diameter of the temporary via holes 33. A small final diameter of holes 33 permits a thinner separation layer 14 and the deposit of smaller or shorter cathode cones, which cones are mechanically more stable than taller cones. In prior know processes for producing planar field emission elements, the original diameter of the milled via holes, e.g., 1.5 microns, remains unchanged throughout the manufacturing process and holes of such diameter require the use of substantially thicker separation layers which, in turn, require thicker and taller cathode cones which can cause shorting between the gate and the X-lines.

Referring again to FIG. 3, conventional reactive ion etching, applied through the temporary via holes 33, causes removal of the etched areas of the separation layer to form via passages 34 which extend down to the upper surface of the resistive layer 13, such as sputtered amorphous silicon, and which is continued long enough to undercut the via layers 32 and 22 so that the final width or diameter of each via passage 34 is about the same as the diameter of each initial via hole 16 in the base anode layer 15, i.e., about 3 microns, as illustrated by FIG. 3. This width of each via passage 34, coupled with the shallowness thereof due to the relative thinness of the separation layer 14, facilitates the evaporation deposit and build up of the cathode cones and reduces the chance of shorting contact between the cathode cones and the separation layer.

Figure 4:
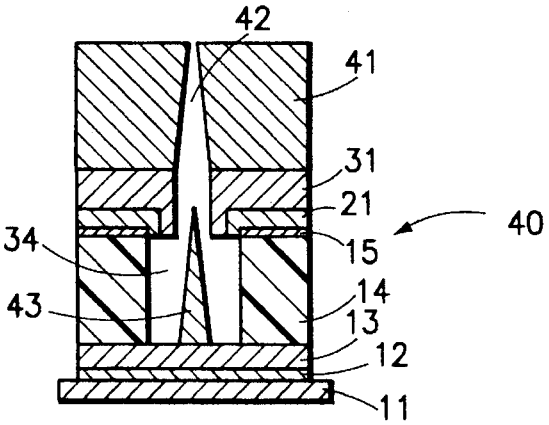
FIG. 4 is an illustration, similar to that of FIG. 3, showing the product after the vapor deposit of a cathode metal through each anode via and over the lift-off layer, to form sharply-tipped or conical emission cathodes.

Referring to FIG. 4 of the drawing, the intermediate element 40 thereof illustrates the element 30 of FIG. 3 after the step of evaporating a desired conductive cathode deposition metal such as molybdenum, which differs from the metal plated to form the lift-off layer 31 e.g., a metal other than copper if copper is used to form layer 31. The deposition metal deposits on the upper surface of the separation layer while portions thereof penetrate each via hole 33 and via passage 34 to deposit and accumulate on a central area of the resistive layer 13 within each via passage 34, spaced from the walls of said via passage. The evaporation deposition is continued until the metal accumulation 41 on the surface of the lift-off layer 31 nearly seals the passage 42 therein, which passage gradually narrows as the deposition progresses. The gradual narrowing of passage 42 produces a gradual reduction of the amount of cathode deposition metal which can penetrate into the via passages 34 and the formation of conical, tipped cathodes 43 which extend from the surface of the resistive layer 13 up into the via holes 33 so that the tips of the cathodes are spaced from and surrounded by the lift-off layer 32/33.

The metal deposition step is preferably accomplished by conventional vapor deposition methods, such as the application of energy to a vapor deposition target of the desired metal, such as molybdenum. The vaporized metal moves in a substantially normal direction to form layer 41 and conical emission cathodes 43. Conventional methods of vapor deposition are preferred over glancing angle evaporation because conventional methods are significantly less expensive and more efficient than glancing angle evaportion, thereby offering enhanced manufacturability of field emission devices.

Figure 5:
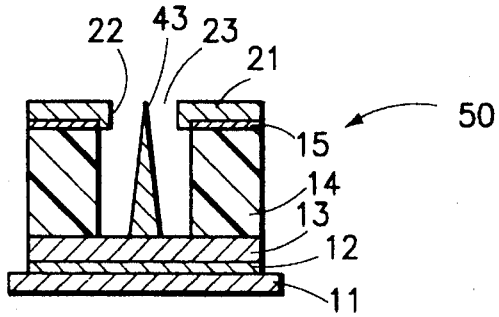
FIG. 5 is an illustration similar to that of FIG. 4, showing the product after selective removal of the lift-off layer and of the cathode metal deposit supported thereover.

The final step for forming the planar field emission element 50 of FIG. 5, ready for Y-line patterning, is the step of selectively deplating or etching away the lift-off layer 31 to undermine or destroy the support for the cathode metal layer 41, whereby layer 41 can be lifted off the element 40 while layer 31 is selectively etched away to form the planar field emission element 50 of FIG. 5.

The formed element 50 can be finalized as an image display device in known manner, such as by facing it with a front panel having an anode electrode and a phosphor layer.

It will be clear to those skilled in the art, in light of the present disclosure, that the novel steps of the present manufacturing process substantially reduce the time and expense required by prior known processes while increasing the precision and durability of the planar field emission devices produced.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Method for producing planar field emission devices comprising the steps of:

(a) patterning a metal cathode layer on the surface of an electrically-insulative substrate;

(b) applying a thin resistive layer over the patterned cathode layer;

(c) applying an etchable polymeric separation layer over the resistive layer;

(d) depositing a thin anode base layer of a conductive metal over the surface of the separation layer;

(e) etching via holes through predetermined spaced areas of the anode base layer;

(f) electroplating the thin anode base layer with a conductive metal top layer to form a composite metal anode layer of increased thickness and strength and to reduce the diameter of each etched via hole;

(g) electroplating the composite anode layer with a metal which differs from the conductive metals of the composite anode layer, to form a lift-off layer which is selectively-removable from said composite anode layer, and to further reduce the diameter of each etched and plated via hole;

(h) exposing the polymeric separation layer, through each reduced-diameter via hole, to etching means to form via passages which extend down to the surface of the resistive layer and which have a diameter larger than the reduced diameter of each via hole;

(i) directing a vaporized conductive cathode metal against the upper surface of the lift-off layer and through the reduced diameter via holes therein to deposit on said lift off layer and in a central area of the surface of the resistive layer within each via passage, and continuing such direction to form a conical conductive metal cathode which extends from the surface of the resistive layer into the reduced diameter via hole, within each said via passage;

(j) selectively removing the lift-off layer which supports the layer of cathode metal accumulated thereon, and (k) removing the unsupported layer of cathode metal.

2. Method according to claim 1 in which the thin resistive layer of step (b) comprises a layer of amorphous silicon deposited by sputtering.

3. Method according to claim 1 in which the thin layer has a thickness between about 1 and 2 microns.

4. Method according to claim 1 in which the separation layer of step (c) comprises a layer of a polyimide polymer.

5. Method according to claim 1 in which the separation layer has a thickness between about 3 and 6 microns.

6. Method according to claim 1 in which the via holes formed in step (e) have diameters of 2 or more microns and the electroplating step (f) reduces the diameter of each said via hole to 1 or less microns.

7. Method according to claim 1 in which the anode top layer formed in step (f) has a thickness between about 0.2 and 1 micron.

8. Method according to claim 1 in which the composite anode layer of step (f) is removed from the surface of the separation layer, and steps (d), (e) and (f) are repeated to form a new composite anode layer having larger or smaller via holes.

9. Method according to claim 1 in which the cathode metal of step (i) comprises molybdenum.

10. Method according to claim 1 in which the lift-off layer is selectively removed in step (j) by de-plating means.

11. Method according to claim 1 in which the lift-off layer of step (g) has a thickness between about 0.2 and 1 micron.

12. Method according to claim 11 in which the lift-off layer comprises 0.5 micron thick copper.

13. Method according to claim 1 in which the etching means of step (h) comprises a reactive ion etching means.

14. Method according to claim 13 in which each via passage has a diameter greater than about 2 microns.

15. Method according to claim 1 in which the thin anode base layer of step (d) has a thickness between about 0.2 and 1 micron.

16. Method according to claim 15 in which the anode base layer comprises 0.5 micron thick nickel.

17. Method according to claim 16 in which the anode top layer also comprises 0.5 micron thick nickel.

18. Method for producing planar field emission devices comprising the steps of:

(a) patterning a metal cathode layer on the surface of an electrically-insulative substrate;

(b) applying a thin amorphous silicon resistive layer over the patterned cathode layer;

(c) applying an etchable polymeric separation layer over the resistive layer;

(d) depositing a 0.2 to 1 micron thick anode base layer of nickel over the surface of the separation layer;

(e) etching via holes through predetermined spaced areas of the anode base layer, each said via hole having a diameter of 2 or more microns;

(f) electroplating the thin anode base layer with a 0.2 to 1 micron thick conductive metal top layer of nickel top layer to form a composite metal anode layer of increased thickness and strength and to reduce the diameter of each etched via hole;

(g) electroplating the composite anode layer with a 0.2 to 1 micron thick layer of copper to form a lift-off layer which is selectively-removable from said composite anode layer, and to further reduce the diameter of each etched and plated via hole;

(h) exposing the polymeric separation layer, through each reduced-diameter via hole, to etching means to form via passages which extend down to the surface of the resistive layer and which have a diameter of about 2 or more microns;

(i) directing a vaporized conductive cathode metal against the upper surface of the lift-off layer and through the reduced diameter via holes therein to deposit on said lift off layer and in a central area of the surface of the resistive layer within each via passage, and continuing such direction to form a conical conductive metal cathode which extends from the surface of the resistive layer into the reduced diameter via hole, within each said via passage;

(j) selectively removing the lift-off layer which supports the layer of cathode metal accumulated thereon, and (k) removing the unsupported layer of cathode metal.

* * * * *